US005169605A

United States Patent [19]

Carpentier

[11] Patent Number: 5,169,605

[45] Date of Patent: Dec. 8, 1992

[54] PROCESS AND INSTALLATION FOR THE COMBUSTION OF TOXIC GASEOUS EFFLUENTS BEREFT OF OXYGEN

[75] Inventor: Serge Carpentier, Villecresnes, France

[73] Assignee: Societe Generale Pour les Techniques Novelles SGN, Saint-Quentin-en-Yvelines Cedex, France

[21] Appl. No.: 675,930

[22] PCT Filed: Sep. 4, 1990

[86] PCT No.: PCT/FR90/00641

§ 371 Date: May 3, 1991

§ 102(e) Date: May 3, 1991

[87] PCT Pub. No.: WO91/03685

PCT Pub. Date: Mar. 21, 1991

[30] Foreign Application Priority Data

Sep. 4, 1989 [FR] France ..... 89 11548

[51] Int. Cl.[5] ..... B01D 50/00; B01D 53/34

[52] U.S. Cl. ..... 422/182; 422/183; 110/210; 110/212; 110/213; 110/214; 423/241; 423/245.3

[58] Field of Search ..... 422/182, 183; 110/210–214; 423/210, 241, 245.3, 248

[56] References Cited

U.S. PATENT DOCUMENTS

| | | | |
|---|---|---|---|
| 3,311,456 | 3/1967 | Denny et al. | 110/212 |
| 3,552,334 | 1/1971 | Springer et al. | 110/214 |
| 4,033,725 | 7/1977 | Reed et al. | 423/248 |
| 4,145,979 | 3/1979 | Lilley et al. | 110/214 |
| 4,199,549 | 4/1980 | Wilt, Jr. et al. | 423/245.3 |
| 4,801,437 | 1/1989 | Konagaya et al. | 423/210 |
| 4,920,898 | 5/1990 | Solbes et al. | 110/214 |

*Primary Examiner*—Robert J. Warden
*Assistant Examiner*—Krisanne M. Thornton
*Attorney, Agent, or Firm*—Fulwider, Patton, Lee & Utecht

[57] ABSTRACT

Process for the combustion of toxic gaseous effluents bereft of oxygen in a flame, comprising an inner cone (8) supplied with combustible gas (6) and with so-called primary combustion-suppporting gas (7). Said gaseous effluent (10) and a so-called secondary combustion-supporting gas (9) are introduced separately at the level of said inner cone, said secondary combustion-supporting gas being introduced in the form of at least one jet directed towards the axis (D) of said inner cone at a flowrate and speed sufficient to ensure an excess of combustion-supporting gas, the maintenance of temperature and to create a turbulent gaseous mass at the level of said inner cone; the toxic gaseous effluent (10) being introduced into said turbulent gaseous mass. Said process is carried out under a depression. It also relates to an installation for carrying out said process.

15 Claims, 2 Drawing Sheets

PROCESS AND INSTALLATION FOR THE COMBUSTION OF TOXIC GASEOUS EFFLUENTS BEREFT OF OXYGEN

The invention relates to a process and an installation for the destruction by combustion of toxic gaseous effluents bereft of oxygen.

The problem of the elimination of such effluents is raised in particular in integrated circuit factories where gases laden with arsenic hydrides (arsines), and/or phosphorus hydrides (phosphines) and/or silicon hydrides (silanes) . . . are employed to dope the materials.

These gases are toxic and the gaseous stream containing them must absolutely be purified before being rejected into the atmosphere.

A known process of treatment consists in burning said gases; the combustion products not being toxic or being able to be easily eliminated (for example by filtration for arsenous oxide).

Patent No. FR 87 03729 published under No. 2 612 606 describes such a process with its associated device. According to this Patent, the effluent is conducted into a combustion zone via a central conduit surrounded by a pipe supplying the combustible gas, itself surrounded by three annular conduits supplying the combustion-supporting air. Every effort is made to remain as long as possible in laminar flow even beyond the burner in order to repel the inflammation zone in order to avoid the deposit of oxides on the burner. The flowrates and speeds of injection of the gases are regulated to that end. To the same end, the stream of combustible gas constitutes a sheath for protecting the effluent with respect to the combustion-supporting gas.

Applicant is proposing at the present time a process of combustion in which, contrary to the prior art, a considerable turbulence is created.

More precisely, the invention has for its object a process for the combustion of toxic gaseous effluents bereft of oxygen in a flame comprising an inner cone supplied with combustible gas and so-called primary combustion-supporting gas, process carried out under depression and in which said gaseous effluent and a so-called secondary combustion-supporting gas are introduced separately at the level of said inner cone, said secondary combustion-supporting gas being introduced in the form of at least one jet directed towards the axis of said inner cone at a sufficient flowrate and speed to ensure an excess of combustion supporting gas, the maintenance of temperature, and to create a turbulent gaseous mass at the level of said inner cone; the toxic gaseous effluent being introduced in said turbulent gaseous mass.

The invention therefore consists in a process of combustion of toxic gaseous effluents, bereft of oxygen. Such effluents are not explosive per se. They may become so in the presence of oxygen.

They are constituted by a vector gas laden with impurities. Said vector gas may be hydrogen, nitrogen, . . . or a mixture of gases. Air and oxygen are obviously excluded.

Said gaseous effluents to be burned according to the process of the invention may, as indicated above, come from the electronic industry. Such effluents are laden with hydride, particularly phosphines, arsines . . . and/or silanes . . . and/or other chemical compounds containing in particular B, P, As, Te, Se, Cl, F atoms.

Said gaseous effluents may also come from the nuclear industry It may be question of radio-active gases of pyrolysis and/or radio-active gases laden with tritium.

The inner cone of the flame is obtained from a conventional burner disposed at the head of the combustion zone, supplied with combustible gas (natural gas for example) and combustion-supporting gas (air for example). This combustion-supporting gas is called primary in the text of the present application in order to distinguish it from the other streams of combustion-supporting gas. The flowrate of this primary combustion-supporting gas is advantageously adjusted so as to ensure combustion with a small excess of combustion-supporting gas (about 10%).

According to the invention, so-called secondary combustion-supporting gas is sent towards the inner cone in the form of jet(s), at a sufficient flowrate to ensure an excess of combustion-supporting gas, with respect to the quantity necessary for the combustion of the toxic effluent, and at a speed sufficient to create a turbulent gaseous mass at the level of the inner cone.

The secondary combustion-supporting gas is for example air.

The flowrate and speed of the secondary combustion-supporting gas are such that the appearance of the inner cone is modified: it changes colour, its shape is disturbed and eddying movements are observed. It is then said that the gaseous mass is turbulent. This phenomenon is known to the man skilled in the art.

The flowrate and speed of the secondary combustion-supporting gas must also be determined in order to ensure maintenance of the temperature in the zone of combustion and the excess of combustion-supporting gas.

The speeds may go up to several tens of m/s.

The secondary combustion-supporting gas is introduced in the form of one or more jets directed towards the axis of said inner cone. These jets may converge towards the axis of the inner cone or be directed so as to create an eddying movement of the combustion-supporting gas around said inner cone; in that case, too, the orientation of the jet participates in the creation of the turbulence.

The process of the invention is carried out, under depression or subambient pressure with respect to the atmosphere outside the zone of combustion (ambient atmosphere). Such a depression or subambient pressure makes it possible to avoid the formation of pockets of gas, to avoid a possible dispersion of the gases towards the outside. Furthermore, it facilitates the extraction of the gases issuing from the installation in which the process is carried out.

This depression or subambient pressure is of the order of 0.5 to 6 mbar (or 50 to 600 Pa).

The secondary combustion-supporting gas is preferably supplied via two different circuits producing:

at least one so-called fixed jet with constant flowrate and speed, sufficient to obtain a turbulent gaseous mass and the desired temperature of combustion;

at least one so-called modulatable jet with a variable flowrate to maintain the temperature; said jets also ensuring the supply of excess combustion-supporting gas.

The stream of modulatable (secondary) combustion-supporting gas cools the gaseous mass and makes it possible to reduce the temperature of the combustion zone, if necessary. The absence of said current causes the temperature to rise, which may be accelerated by regulating the flowrate of combustible gas/primary combustion-supporting gas.

Within the framework of the invention, it suffices that the toxic gaseous effluent be introduced in the form of a jet in the turbulent gaseous mass (one or more jets). The place where the jet(s) of effluent arrive(s) with respect to the admission(s) of secondary combustion-supporting gas is of little importance; it suffices that the turbulence be created on the gaseous mass.

When the toxic effluents are of different nature, they may be introduced in the form of jets separated at the level of the inner cone, or be mixed before being introduced.

The toxic effluent may be introduced episodically. The flowrate of secondary combustion-supporting gas is generally determined by the measurement of the temperature in the combustion zone. The process of the invention advantageously enables effluents whose flowrate and speed are not controlled, to be treated; in that case it suffices to adjust the flowrates and speeds of combustion-supporting gas in order to obtain combustion.

The temperature in the combustion zone is generally greater than 900° C. for the treatment of the toxic gases mentioned hereinabove. Said temperature is advantageously chosen so as to obtain an at least 99% destruction of the toxic gases on all the installation—i.e. combustion zone possibly completed by a post-combustion zone in which the reaction terminates —in which the process of the invention is carried out.

In any case, it will be chosen by the man skilled in the art to be higher than a critical temperature: the temperature of explosivity of the gas mixture in the combustion zone. Whatever this mixture, the man skilled in the art situates this critical temperature at around 800° C.

In the absence of effluent to be treated, it is advantageous to place the installation in standby at a temperature very slightly higher than the temperature of explosivity of the gases then present in the combustion zone.

In order to allow the reaction of combustion to continue, it is advantageous to send the gases issuing from the combustion zone towards a so-called post-combustion zone containing a lining of refractory materials. Such lining is advantageously taken to a temperature higher than the temperature of combustion in the combustion zone. Said lining also ensures filtration of the gases and a better distribution of the calories in the installation.

Said post-combustion zone is obviously likewise under a depression or subambient pressure preferably 0.5 to 6 mbar).

It may be judicious to provide in the top of the post-combustion zone (part opposite the bottom containing the lining), a leakage bringing a slight current of so-called tertiary combustion-supporting gas (generally air) which guarantees an excess of combustion-supporting gas in the post-combustion zone.

The flowrates and speeds of the combustion-supporting gases are regulated so as to obtain a temperature of 900° to 1200° C., preferably around 1000° C., in the post-combustion zone, within the framework of an application to the toxic effluents mentioned above.

The issuing gases may be rejected directly into the atmosphere or be treated, depending on the quantity of residual toxic matter and the rejection standards in force.

The present invention also relates to an installation for the combustion of toxic gaseous effluents bereft of oxygen, in which the process described hereinabove may be carried out. Said installation comprises:

a tunnel or combustion zone of which the bottom is constituted by a conical wall open on said tunnel and of the same axis thereas; a burner supplied with combustible gas and with primary combustion-supporting gas being disposed on this axis so that the base of the inner cone is located in the vicinity of the bottom of the tunnel, at least one pipe for supplying the secondary combustion-supporting gas to the level of the bottom of said tunnel, said pipe(s) being oriented so that said combustion-supporting gas is directed in jet(s) towards the inner cone, at least one pipe for supplying the toxic gaseous effluent to the level of the bottom of said tunnel, said pipe(s) being oriented so that the effluent is directed in jet(s) converging towards the axis of the inner cone, a gas extraction device, creating a depression or subambient pressure in said tunnel.

The installation according to the invention comprises a combustion tunnel of which the bottom is constituted by a conical wall. This wall is generally constituted by refractory materials over a sufficient thickness to ensure heat insulation of the installation from the outside.

In the bottom of the cone, a recess is arranged for the burner. The burner comprises a pipe for the admission of the combustible gas and another pipe for the admission of the primary combustion-supporting gas.

This may for example be a tap hole made at the bottom of the tunnel, in which the burner opens out, the inner cone in that case developing in the tap hole.

In another embodiment, the burner comprises two concentric pipes, and the pipe supplying the combustible gas is recessed with respect to the bottom of the cone of the tunnel, in order to facilitate the mixture of combustible gas/primary combustion-supporting gas before the development of the inner cone, the base of the inner cone being virtually at the level of the bottom of the cone of the combustion tunnel.

Means for regulating the flowrates are provided on these pipes; they are preferably determined by the measurement of the temperature in the installation.

The admissions of secondary combustion-supporting gas and of toxic effluent open out on the conical wall of the combustion tunnel.

The secondary combustion-supporting gas is supplied via one or more pipes which traverse the conical wall over the whole thickness thereof, the pipes are dimensioned so that the gas escapes in the form of a jet. These pipes may be given the form of a slot so as to cover a larger surface by the jets.

A more favourable embodiment consists in providing a plurality of pipes, for example three or four, disposed regularly over the periphery of the conical wall. Depending on the case, the pipes are disposed so that the jets converge towards the axis of the inner cone substantially at the same point, or they are inclined identically on the periphery of the conical wall so as to create a rotating movement of the combustion-supporting gas introduced.

The pipe(s) supplying the effluent also traverse(s) the conical wall and is (are) disposed so as to direct the jet(s) of effluent towards the axis of the inner cone substantially at the same point. A plurality of pipes are preferably disposed, distributed regularly over the periphery of the conical wall.

Pipes for secondary combustion-supporting gas for so-called fixed jets and pipes for so-called modulable jets are preferably provided, each type of jet being piloted independently of the other.

In a particular embodiment, pipes are provided, which are separated into two parts by a wall, the jets in that case opening out substantially at the same spot.

The dimensions of the combustion tunnel are determined by the man skilled in the art as a function of the products treated, of the combustion temperature to be obtained, of the dwell time . . .

A device, for example an extraction fan 19, is mounted on the gas extraction pipe in order to create the depression in the installation.

An advantageous installation comprises a combustion tunnel followed by a post-combustion zone, said zone also comprising walls made of refractory material and its axis advantageously making an angle with that of the combustion tunnel. The bottom of said zone is provided with a lining made of refractory material and a lateral pipe allows the gases having traversed said lining to issue.

In the top part of the post-combustion zone (the top part being opposite the bottom), an admission flap valve may be arranged, allowing the passage of combustion-supporting gas (tertiary) towards the bottom of said post-combustion zone. Said flap valve is advantageously used as expansion valve to compensate accidental overpressures.

BRIEF DESCRIPTION OF THE DRAWINGS

The following Figures illustrate the invention:

FIG. 1A shows an installation comprising a combustion tunnel 1 of axis (D) followed by a post-combustion zone 2 disposed perpendicularly to said tunnel.

Figure 2A:
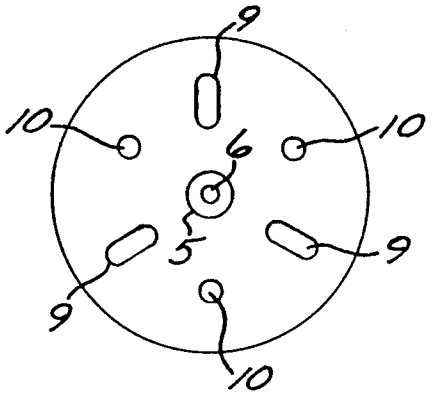
FIGS. 2A, 2B and 3A show in section (seen along the axis of the combustion tunnel) the bottom of the tunnel with the burner and the pipes for the gases.

The bottom of the tunnel 1 is constituted by a conical wall 3 open on the tunnel. The tunnel with its bottom is surrounded by a thickness 4 of refractory bricks (or other material) to ensure heat insulation.

In the bottom of the tunnel, a recess is arranged along axis (D) and over the whole thickness of the conical wall. A burner 5 is embedded therein, which comprises a conduit 6 for admission of combustible gas (natural gas) and a conduit 7 supplying the primary combustion-supporting gas (air). An inner cone 8 develops in the bottom of the tunnel.

Figure 1A:
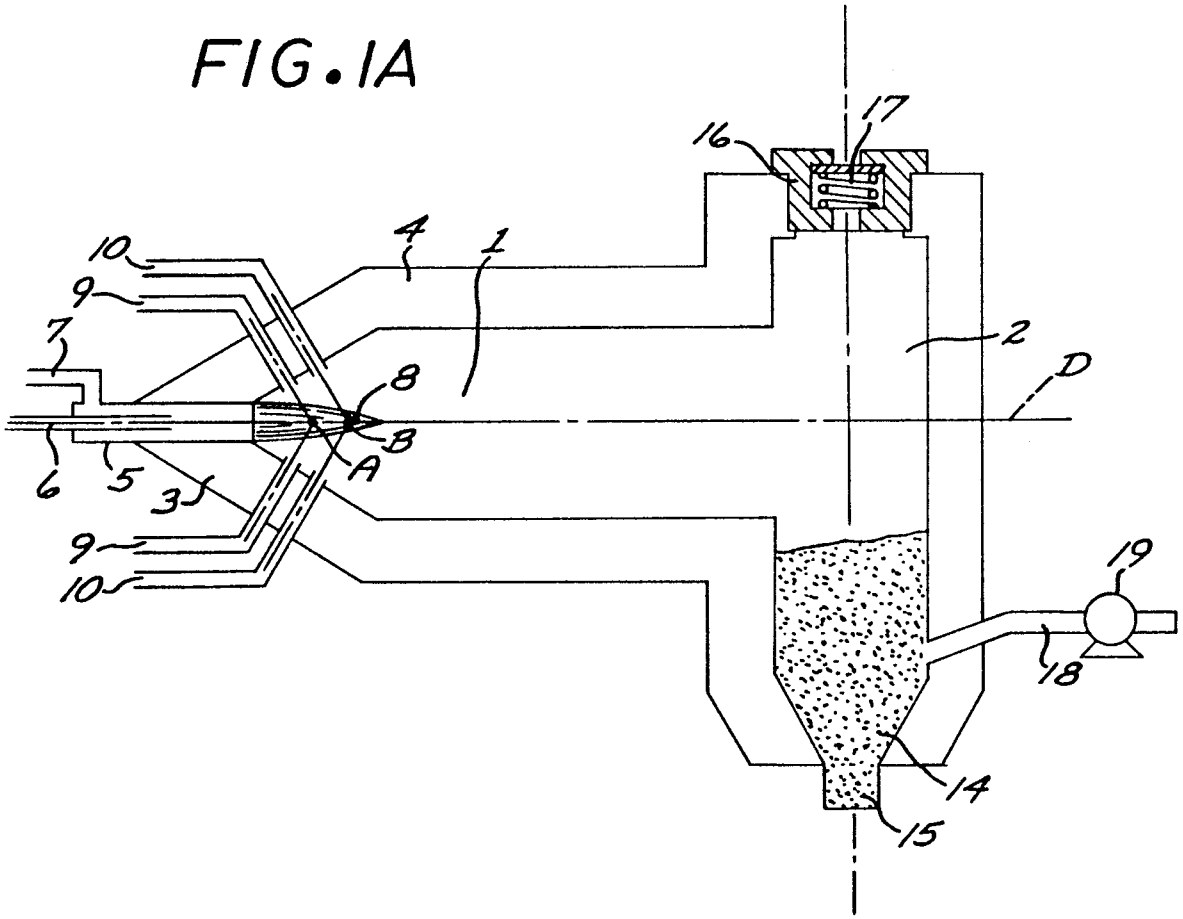
FIGS. 1A and 1B show preferred embodiments of the installation according to the invention.
Figure 1B:
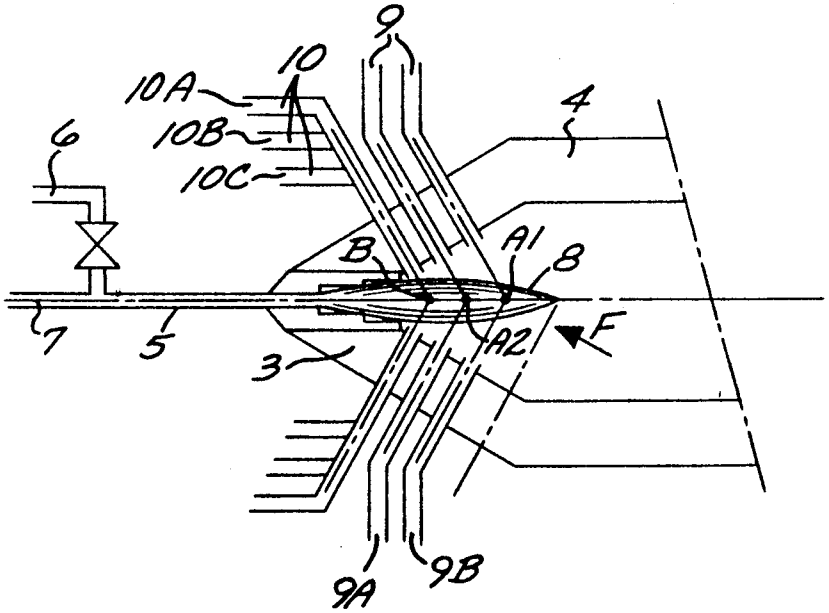

In FIG. 1A, the base of the inner cone is at the bottom of the cone of the conical wall; in FIG. 1B, it is located in the tap hole placed on the recess arranged in the bottom of the cone.

Pipes 9 and 10 traverse the conical wall to supply the secondary combustion-supporting gas (air) and the toxic effluent, respectively.

In the example illustrated FIG. 2A, there are three pipes 9 and three pipes 10. Pipes 9 are disposed so that their axes converge on axis (D) of the tunnel at a point A, pipes 10 at a point B and point B is located beyond point A.

On the contrary, in FIG. 1B, pipes 9 converge at points A1 and A2, pipes 10 at point B and points A1 and A2 are located beyond point B.

In the section of FIG. 2A, according to one embodiment of the invention, pipes 9 supplying the secondary combustion-supporting gas have the form of a slot, whilst pipes 10 are circular in shape.

Figure 3A:
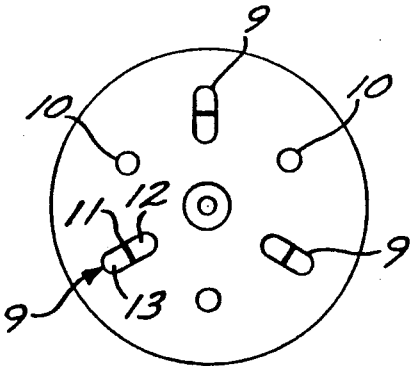

FIG. 3A presents a preferred variant, in which the pipes 9 are separated into two parts by a partition 11. In part 12, closest to the burner, there circulates the secondary combustion-supporting gas with fixed jet and in part 13, the secondary combustion-supporting gas with modulable jet. The two parts are then supplied via different pipes. Appropriate means for regulating flowrate and speed are placed on the supply pipes.

FIG. 1B shows separate pipes 9A and 9B to supply the secondary combustion-supporting gas in the form of respectively modulable and fixed jet.

Figure 2B:
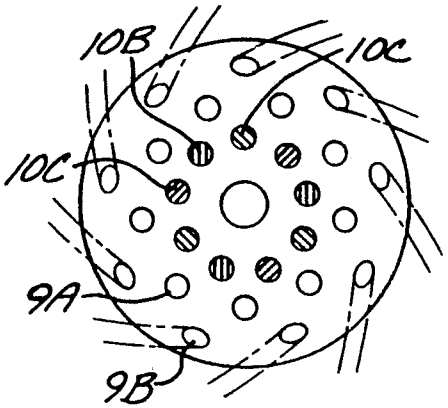
Figure 3B:
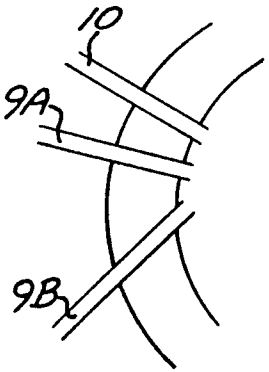
FIG. 3B shows a view in section of the installation 1B in direction F.

FIG. 2B shows in section the pipes 9B inclined so as to create a rotating movement of the so-called fixed jet, secondary combustion-supporting gas around the inner cone.

Pipes 10 are distributed in three groups of three pipes 10A, 10B, 10C which each supply a toxic effluent of different nature, for example. The pipes of the groups are regularly disposed on the periphery of the conical wall.

According to FIG. 1A, the gases issuing from the combustion tunnel 1 are deviated towards the post-combustion zone 2 which contains in its bottom a lining 14 (for example of silicon carbide) which may be evacuated through a tapping door 15 and supplied through a door 16. Door 16 may comprise a flap valve 17 via which the tertiary combustion-supporting gas (air) then arrives, which is entrained with the combustion gases towards the lining. The gases having traversed the lining leave the installation via pipes 18.

The invention is illustrated by the following example. In an installation of the type described hereinabove, of which the cylindrical combustion chamber has an outer diameter of about 1200 mm, an inner diameter of about 400 mm, an approximate inner length of 1600 mm and of which the post-combustion chamber—which follows said combustion chamber—contains aggregates of silicon carbide, a gas laden with arsine, at 6000 ppm in volume, has been treated at a flowrate of 14 $Nm^3/h$.

At the head and in the axis of the combustion tunnel is found a burner tap hole supporting the burner proper and the admissions of air and of gas.

The vector gas laden with arsine is sent in the tap hole towards the combustion tunnel. It is composed of:

hydrogen: 10.2 $Nm^3/h$ nitrogen: 3.0 $Nm^3/h$.

The combustible gas used is natural gas, supplied at a flowrate of 1.1 $Nm^3/h$ at the nose of the burner previously mixed in the burner with 6 $Nm^3/h$ of primary air (primary combustion-supporting gas). The air/gas proportion has been maintained constant, whatever the appearance of the flame of the burner, with an excess of air of 10% with respect to the stoichiometry.

Via the tap hole of the burner there also arrives, at a speed of 12 m/s, the secondary combustion-supporting gas composed of:

air at constant flowrate (33 $Nm^3/h$) and at constant speed (12 m/s) for the turbulent scavenging of the combustion tunnel, modulated air at variable flowrate (from 0 to 35 $Nm^3/h$) for maintaining the temperature.

The depression or subambient pressure in the tunnel is 5 mbar.

The temperature measured before the lining of silicon carbide is 1000° C. The volume of the fumes at this temperature is 90 $Nm^3/h$.

Said fumes are then cooled from 1000° C. to 700° C. in a heat exchanger then undergo a dilution, by ambient air, by a factor 4 (325 $Nm^3/h$) to be taken down to a temperature of 100°-120° C. before a filtration of very high efficiency (to stop 99.99% of the particles of the order of 0.3 μm) aiming at retaining the solid arsenous acid formed, before rejection in the chimney stack.

At that level, the load of arsine is now only 0.5 ppm in volume. The purification yield ensured by the installation is therefore 99.966%, greater than the 99.95% required (after having taken into account the dilution at cooling).

In addition, the composition of the fumes in the chimney stack was approximately as follows:

nitrogen: 80.0%
oxygen: 18.0%
water (steam): 1.5%
carbon dioxide gas: 0.5%

Such an installation is particularly well adapted to the purification of the gases issuing from the electronic industry: not only there is virtually complete combustion of the toxic combustible elements, but the formation of nitrogen oxides or other toxic gases is avoided.

I claim:

1. Process for the combustion of a toxic gaseous effluent bereft of oxygen, comprising the steps of:

projecting a flame, burning a mixture of a fuel and a primary oxidizer gas, into a combustion zone;

maintaining said combustion zone at subambient pressure;

injecting into said flame a secondary oxidizer gas in a manner and at a flowrate and velocity sufficient so as to create a turbulent gaseous mass, to maintain an excess of oxidizer gas and to maintain a preselected temperature; and introducing said toxic gaseous effluent into said turbulent gaseous mass of said flame.

2. Process of claim 1 wherein said combustion zone is maintained at a pressure of from 50 to 600 Pa.

3. Process of claim 1 wherein said secondary oxidizer gas is injected into said flame via a fixed jet delivering secondary oxidizer gas at a constant flowrate and velocity and a modulatable jet delivering secondary oxidizer gas at a variable flowrate and velocity.

4. Process of claim 3 wherein the flowrate and velocity of secondary oxidizer gas delivered by said modulatable jet is varied as a function of the temperature within the combustion zone.

5. Process of claim 14 further comprising the step of conducting gases issuing from said combustion zone into a post-combustion zone.

6. Process of claim 5 wherein said combustion zone and said post-combustion zone are maintained at a pressure of from 50–600 Pa.

7. Process of claim 5 further comprising the step of introducing a tertiary oxidizer gas into said gases issuing from said combustion zone so as to maintain an excess of oxidizer gas in said post combustion zone.

8. Process of claim 5 wherein a temperature of between 900° and 1200° C. is maintained in said post combustion zone.

9. Process of claim 18 wherein a temperature of 1000° C. is maintained in said post-combustion zone.

10. Process of claim 1 wherein said toxic gaseous effluent includes at least one constituent selected from the group consisting of silane, B, P, As, Te, Se, Cl, and F.

11. Apparatus for the combustion of toxic gaseous effluents bereft of oxygen, comprising:

a combustion tunnel oriented along a longitudinal axis and terminating in a conically walled end;

a burner, situated in said conically walled end and operative to project a flame of burning fuel and primary oxidizer gas into said tunnel along said axis;

means for injecting secondary oxidizer gas into said flame adjacent the burner so as to maintain turbulence therein;

means for injecting said gaseous effluents into said turbulent flame adjacent the burner; and means for maintaining subambient pressure within said combustion tunnel.

12. Apparatus for claim 11 wherein said means for injecting secondary oxidizer gas into said flame comprises slots disposed in said conically walled end.

13. Apparatus of claim 11 wherein said means for injecting secondary oxidizer gas into said flame comprises at least one fixed jet and one modulatable jet.

14. Apparatus of claim 11 further comprising a post-combustion zone arranged along an axis perpendicular to said longitudinal axis, said post-combustion zone being provided at one end with a lining of refractory materials.

15. Apparatus of claim 14 further comprising a flap valve disposed at said post-combustion zone's opposite end.

* * * * *

UNITED STATES PATENT AND TRADEMARK OFFICE

CERTIFICATE OF CORRECTION

PATENT NO. : 5,169,605
DATED : December 8, 1992
INVENTOR(S) : Serge Carpentier

It is certified that error appears in the above-indentified patent and that said Letters Patent is hereby corrected as shown below:

Column 8, line 1, claim 5, delete [14] insert --1--.

Column 8, line 1, claim 9, delete [18] insert --8--.

Signed and Sealed this

Twenty-sixth Day of October, 1993

*Attest:*

Bruce Lehman

BRUCE LEHMAN

*Attesting Officer*

*Commissioner of Patents and Trademarks*